US006158778A

United States Patent [19]

Vijuk et al.

[11] Patent Number: 6,158,778

[45] **Date of Patent: *Dec. 12, 2000**

[54] METHODS OF FOLDING OUTSERTS

[75] Inventors: Joseph M. Vijuk, 403 Royal Glen Ct., Oak Brook, Ill. 60521; Robert Vijuk, Downers Grove, Ill.

[73] Assignee: Joseph M. Vijuk, Oak Brook, Ill.

[ * ] Notice: This patent is subject to a terminal disclaimer.

[21] Appl. No.: 09/470,374

[22] Filed: Dec. 22, 1999

Related U.S. Application Data

[63] Continuation of application No. 09/305,966, May 6, 1999, which is a continuation of application No. 09/031,191, Feb. 26, 1998, Pat. No. 5,909,899, which is a continuation of application No. 08/492,213, Jun. 19, 1995, Pat. No. 5,813,700, which is a continuation-in-part of application No. 08/324,350, Oct. 17, 1994, abandoned, which is a continuation-in-part of application No. 08/264,181, Jun. 22, 1994, Pat. No. 5,458,374, which is a continuation of application No. 08/037,294, Mar. 26, 1993, abandoned.

[51] Int. Cl.[7] ..... B42D 15/04; B42D 15/00

[52] U.S. Cl. ..... 283/67; 283/81; 283/61; 283/62; 281/2; 281/5; 428/40; 428/130; D20/21; D20/22

[58] Field of Search ..... 283/67, 81, 61, 283/63; 281/2, 5; 428/40, 130

[56] References Cited

U.S. PATENT DOCUMENTS

| | | | |
|---|---|---|---|
| Re. 30,958 | 6/1982 | White | 40/310 |
| 1,239,965 | 9/1917 | Reinhold . | |
| 1,326,859 | 12/1919 | Grammar . | |
| 1,853,829 | 4/1932 | Maury | 283/34 |
| 2,751,222 | 6/1956 | Dexter | 270/81 |
| 2,862,624 | 12/1958 | Stokes | 281/21.1 X |
| 3,760,520 | 9/1973 | Hamilton | 40/102 |
| 3,773,314 | 11/1973 | Giovannini | 270/63 |
| 4,010,299 | 3/1977 | Hershey, Jr. et al. | 40/310 X |
| 4,097,067 | 6/1978 | Schechter | 283/62 X |
| 4,229,926 | 10/1980 | Rowling | 53/429 |
| 4,270,742 | 6/1981 | Kobayashi | 270/37 |
| 4,583,763 | 4/1986 | Shacklett, Jr. | 281/2 X |
| 4,606,553 | 8/1986 | Nickerson | 281/5 |
| 4,616,815 | 10/1986 | Vijuk | 270/45 |
| 4,637,633 | 1/1987 | Instance | 283/81 |
| 4,660,856 | 4/1987 | Shacklett, Jr. | 281/5 |
| 4,812,195 | 3/1989 | Vijuk | 156/357 |
| 4,817,931 | 4/1989 | Vijuk | 270/18 |
| 4,850,611 | 7/1989 | Skelton | 251/5 |
| 4,887,373 | 12/1989 | Macaulay | 40/119 |
| 4,905,977 | 3/1990 | Vijuk | 270/45 |
| 4,906,024 | 3/1990 | Lein | 283/34 X |
| 4,997,205 | 3/1991 | Hansch | 281/2 |
| 5,044,873 | 9/1991 | Vijuk | 414/712.5 |
| 5,046,710 | 9/1991 | Vijuk | 270/37 |
| 5,156,898 | 10/1992 | McDonald | 428/130 X |
| 5,234,231 | 8/1993 | Hollander et al. | 281/2 |
| 5,351,991 | 10/1994 | McDonald | 281/5 X |
| 5,458,374 | 10/1995 | Vijuk et al. | 281/2 X |
| 5,667,210 | 9/1997 | DeLise, Jr. | 270/37 |
| 5,685,530 | 11/1997 | DeLise | 270/37 |
| 5,813,700 | 9/1998 | Vijuk et al. | 283/81 |
| 5,909,899 | 6/1999 | Vijuk et al. | 283/81 |

FOREIGN PATENT DOCUMENTS

| | | | |
|---|---|---|---|
| 744196 | 4/1933 | France | 281/5 |
| 1403865 | 5/1965 | France | 281/5 |
| 10939 | 9/1880 | Germany | 281/5 |
| 28013 | 12/1907 | United Kingdom | 283/34 |
| 20385 | 10/1914 | United Kingdom | 283/34 |

*Primary Examiner*—A. L. Wellington
*Assistant Examiner*—Alisa L. Thurston
*Attorney, Agent, or Firm*—Marshall, O'Toole, Gerstein, Murray & Borun

[57] ABSTRACT

Methods of forming outserts used to provide printed information to the users and purchasers of pharmaceutical products in which a sheet of paper is folded a number of times in a direction parallel to a first direction and then folded a number of times in a second direction perpendicular to the first direction. The folds in the second direction are made to produce an outsert having no unfolded exterior sheet edges which lie in a direction parallel to the second direction.

10 Claims, 10 Drawing Sheets

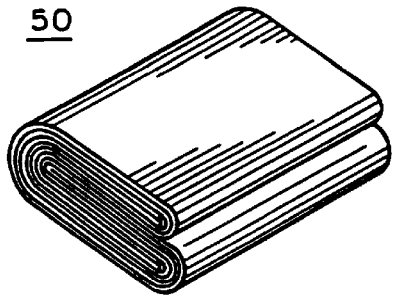
FIG. 4A
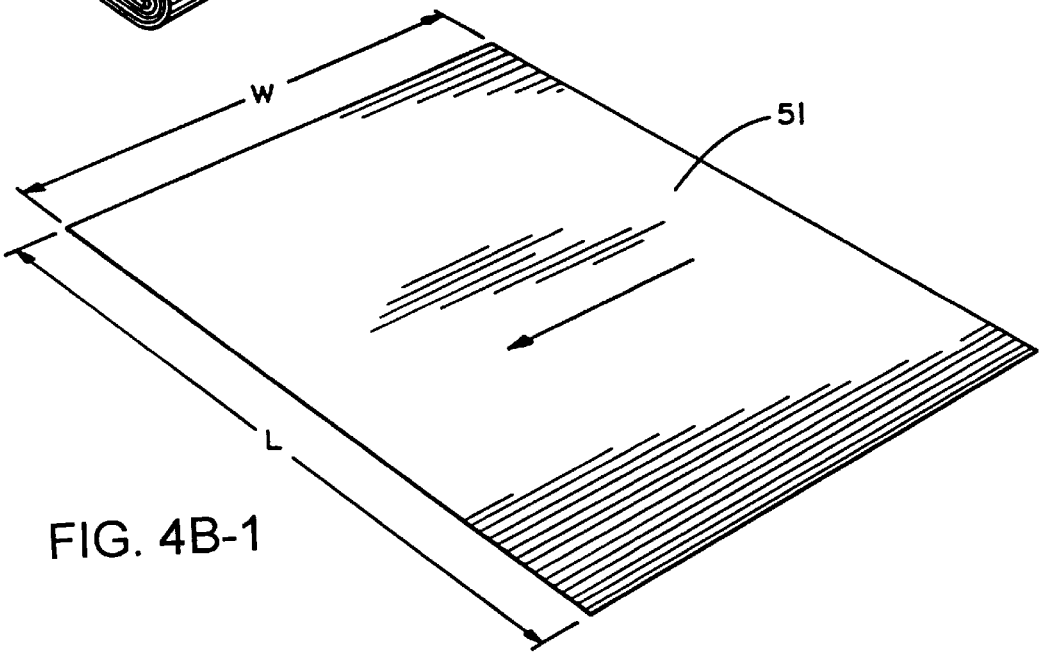
FIG. 4B-1
FIG. 4B-2
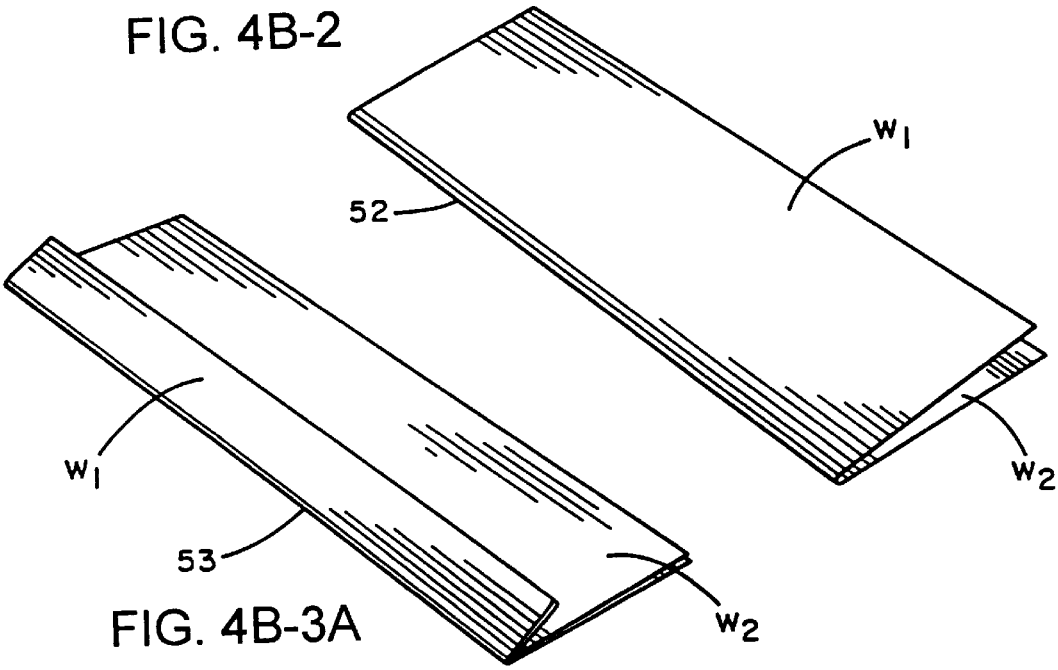
FIG. 4B-3A

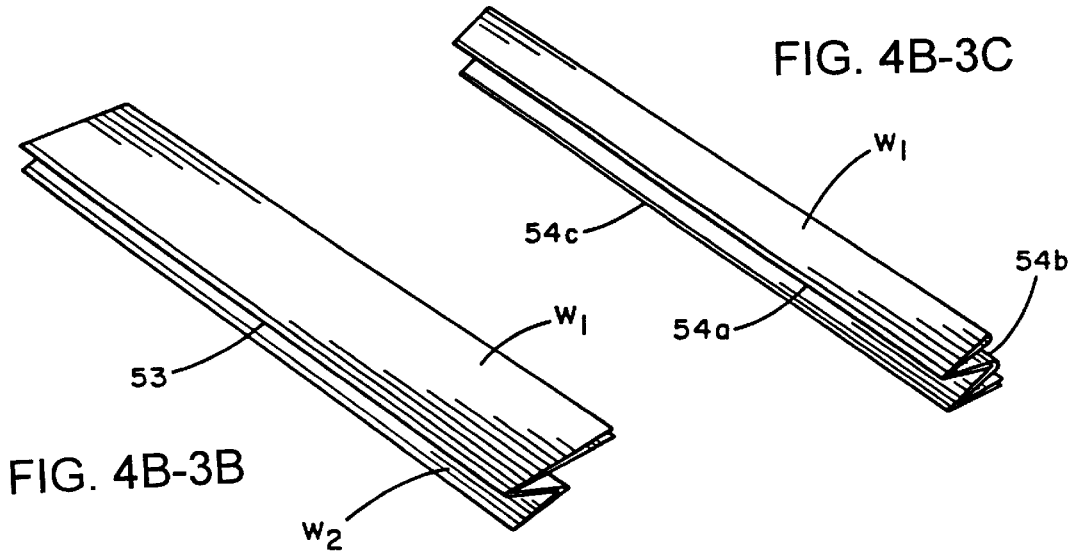
FIG. 4B-3C
FIG. 4B-3B
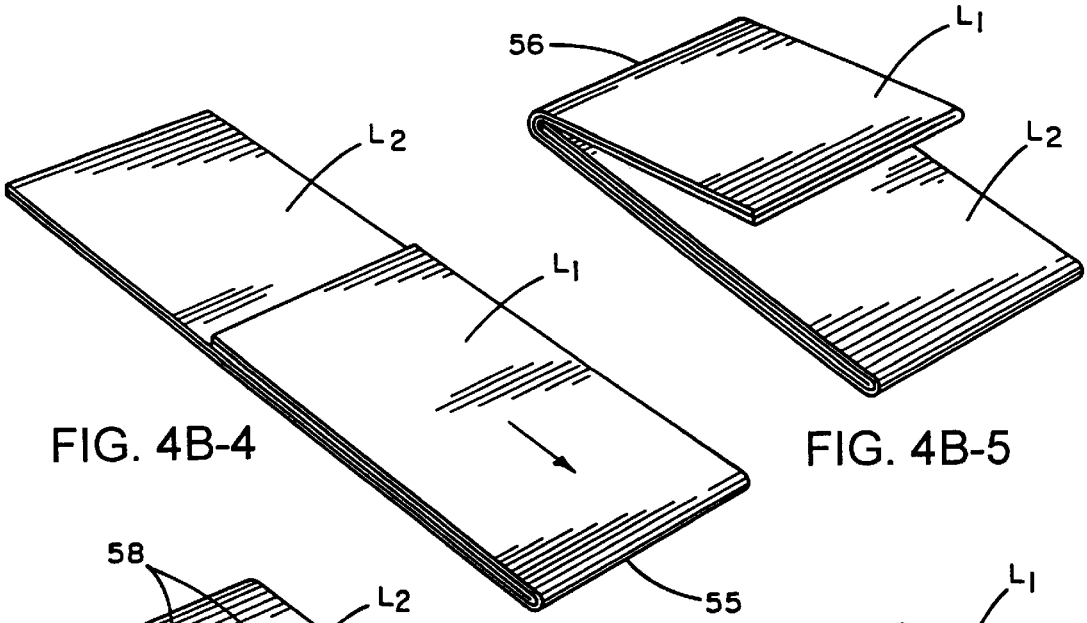
FIG. 4B-4
FIG. 4B-5
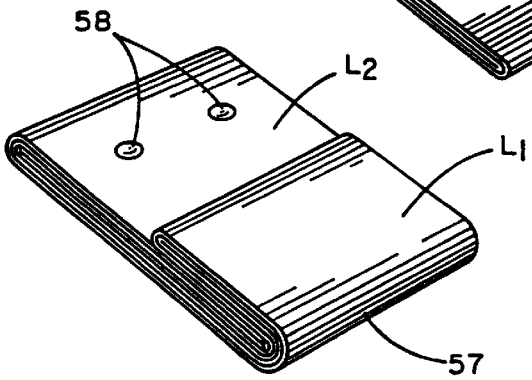
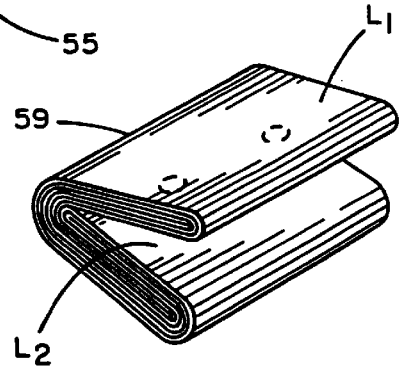
FIG. 4B-6
FIG. 4B-7

METHODS OF FOLDING OUTSERTS

This is a continuation of U.S. application Ser. No 09/305,966, filed May 6, 1999, which was a continuation of U.S. application Ser. No 09/031,191, filed Feb. 26, 1998, now U.S. Pat. No. 5,909,899, which was a continuation of U.S. application Ser. No 08/492,213, filed Jun. 19, 1995, now U.S. Pat. No. 5,813,700, which was a continuation-in-part of U.S. Ser. No 08/324,350, filed Oct. 17, 1994, now abandoned, which was a continuation-in-part of U.S. Ser. No 08/264,181, filed Jun. 22, 1994, now U.S. Pat. 5,458,374, which was a continuation of U.S. Ser. No 08/037,294, filed Mar. 26, 1993 abandoned.

BACKGROUND OF THE INVENTION

This invention relates to methods of folding outserts which have printed information, such as instructions and/or warnings, relating to pharmaceutical products.

Outserts are used to convey information to purchasers and users of pharmaceutical products. The information printed on an outsert typically includes instructions for use of a pharmaceutical product and medical warnings relating to the product. The outsert typically accompanies the product, such as by being affixed directly to the container in which the pharmaceutical product is provided or by being enclosed within a cardboard carton in which the pharmaceutical container is packaged.

FIG. 1A illustrates an example of an outsert 10 constructed in accordance with the prior art which has open edges 12 about its periphery. Under certain circumstances, the open edges 12 of the outsert will tend to cause bottlenecks, or other manufacturing yield problems, with respect to the overall high-speed manufacturing environment that is associated with manufacturing the outsert, or with respect to the specific in-line packaging equipment that is utilized.

A method of forming outserts is disclosed in U.S. Pat. No. 4,812,195 to Michael Vijuk. In that patent, outserts are manufactured by folding a relatively long sheet a number of times in a direction perpendicular to the length of the sheet and then cutting the folded sheet a number of times in a direction perpendicular to the folding direction to make a number of individual outserts. The result of the folding and cutting steps is a "ribbon" style outsert like the one shown in FIG. 1B.

FIG. 1B illustrates a conventional ribbon style outsert 14 constructed in accordance with the prior art and which has limited copyspace due to its overall shape, design and method of manufacture. The outsert 14 has a tail portion 16 which, prior to opening of the outsert by the purchaser of the associated pharmaceutical product, is glued to an interior portion of the outsert. The tail portion 16 consists of a single sheet having an unfolded, exterior sheet edge which lies in a direction parallel to the folding direction.

Increasing the length of a ribbon style outsert will increase manufacturing yield problems in a high-speed manufacturing environment (that is associated with the manufacturing the outsert) as the thickness of the outsert increases and the number of folds with a thicker outsert are attempted, all of which will tend to cause bottlenecks with respect to the dedicated or particular in-line folding and packaging equipment that is utilized during the manufacturing of the outsert.

The invention is directed to a method of producing a folded item having printed information thereon to provide information about a product. The method includes the steps of: (a) forming a first folded article having a first end, a second end, a length along a first direction, and a width along a second direction perpendicular to the first direction, the first folded article having a plurality of first elongate sheet portions and a plurality of second elongate sheet portions. Each of the first elongate sheet portions has a first end and a second end, each of the second elongate sheet portions has a first end and a second end, and each of the first ends of the first elongate sheet portions are joined to a respective one of the first ends of the second elongate sheet portions at a respective fold coinciding with the first end of the first folded article so that the first end of the first folded article has no exterior unfolded sheet edges.

The method also includes the step of (b) folding the first folded article by making a transverse fold in the first folded article to form a second folded article. The second folded article has a first end and a second end, and the transverse fold in the first folded article is parallel to the second direction and is made so that the second end of the first folded article is disposed between the first end of the second folded article and the second end of the second folded article. The transverse fold is made at a point along the length of the first folded article that is spaced from the second end of the first folded article by a distance equal to approximately one-third of the length of the first folded article.

The method also includes the step of (c) making a transverse fold in the second folded article in a direction parallel to the second direction to form the folded item. The transverse fold in the second folded article is made so that the second end of the first folded article is covered by one of the sheet portions of the folded item and so that the folded item has no exterior unfolded sheet edges that lie in a direction parallel to the second direction. The transverse fold in the second folded article is made at a point approximately equidistant between the first end of the second folded article and the second end of the second folded article.

The invention is also directed to articles folded in accordance with the above methods.

The features and advantages of the invention will be apparent to those of ordinary skill in the art in view of the detailed description of the preferred embodiments, which is made with reference to the drawings, a brief description of which is provided below.

BRIEF DESCRIPTION OF THE DRAWINGS

FIGS. 3B-1 through 3B-6 illustrate the method of forming the outsert illustrated in FIG. 3A;

FIG. 4A is a perspective view of a third embodiment of an outsert;

FIGS. 4B-1 through 4B-7 illustrate the method of forming the outsert illustrated in FIG. 4A;

FIG. 5 is a perspective view of an outsert applied to the outside of a container for a pharmaceutical product;

FIGS. 6B-1 through 6B-10 illustrate the method of forming the outsert illustrated in FIG. 6A;

FIGS. 7B-1 through 7B-10 illustrate the method of forming the outsert illustrated in FIG. 7A; and FIG. 8 is a perspective view of an outsert applied to the top of a container for a pharmaceutical product.

DETAILED DESCRIPTION OF THE PREFERRED EMBODIMENTS

Figure 2A:
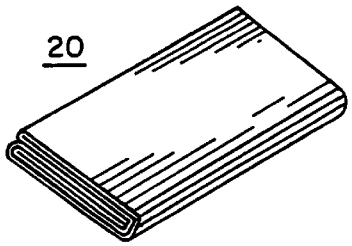
FIG. 2A is a perspective view of a first embodiment of an outsert.
Figures 1, 2B:
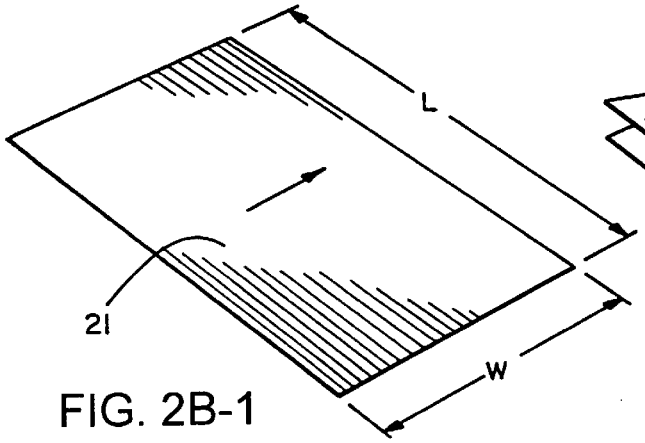

FIG. 2A is a perspective view of a universal, nonjamming, multi-ply outsert 20 having multiple folds, which is manufactured from an integral sheet of stock. FIGS. 2B-1 2B-5 illustrate the method of forming the outsert 20 depicted in FIG. 2A. Referring to FIGS. 2A and 2B, the method starts with web stock that is directly fed to an in-line cutter, where the stock is cut into separate individual sheets (or, alternatively, starting with individual sheet stock which is automatically stacked and fed). The size of the individual sheet stock is variable. For example, it has been demonstrated that starting with a commercial grade sheet stock having an overall length (L) of approximately 8.375 inches, and an overall width (W) of approximately 4.125 inches, an outsert can be manufactured having a total of four folds, twelve total ply thickness, and an overall size of approximately 2.438 inches wide, approximately 1.5 inches high, and approximately 0.125 inches thick (depending on the thickness of the individual sheet stock used).

Figures 2, 2B:
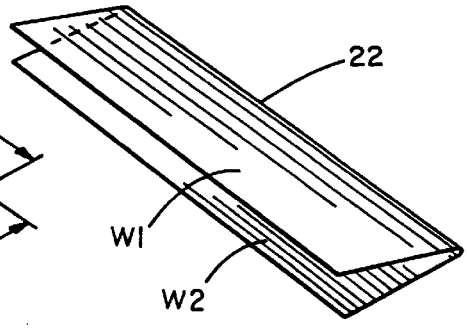

To manufacture the outsert depicted in FIG. 2A, starting at FIG. 2B-1,and with the individual sheet stock 21 traveling in a predetermined first direction, an initial fold 22 is made across the entire length of the sheet stock and is at a right angle from the point of origin (see FIG. 2B-2). This initial fold may be an even fold or an uneven fold (i.e., may be folded over to less than all of the adjoining section of sheet stock). This initial fold results in the sheet stock having a top panel (W1) and an adjoining bottom panel (W2). If the initial fold is an even fold, the resulting width will be ½ of the initial width (i.e., W1=W2=½ W). Following completion of this initial fold, the sheet stock will have an overall thickness of two plies.

Figures 2, 2B, 3:
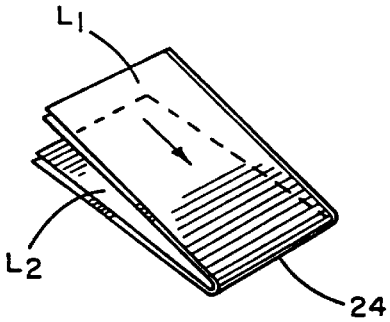

At FIG. 2B-3 and following the re-orientation of the individual sheet stock 21 to a different predetermined second direction (i.e., re-oriented substantially 90 degrees from the first direction), a second fold 24 is then made across the entire width of the sheet stock at a designated location and is at a right angle from the point of origin. This second fold may be an even fold or an uneven fold (i.e., may be folded over to less than all of the adjoining section of the sheet stock). This second fold will result in the sheet stock having a top panel length (L1) and an adjoining bottom panel length (L2).

If the second fold is an even fold, the resulting length will be ½ of the initial length (i.e., L1=L2=½ L). Following completion of this second fold, the sheet stock will have an overall thickness of four plies. Also, after completion of this second fold, the resulting folded sheet stock will have two ends of orientation, one end being a folded closed-end, and the other end being an open-edge end, not having any fold.

At FIG. 2B-4, a third fold 26 is made across the entire width of the sheet stock at a right angle from the point of origin, the third fold being located at the open-edge end of the folded sheet stock. This third fold is equal to approximately ⅓ of the total panel length and will result in the sheet stock now having a resulting top panel length (L1) and a resulting adjoining bottom panel length (L2) (i,e., L1 =⅓ L and L2=⅔ L). Following completion of this third fold, the sheet stock will have an overall thickness of eight plies for the resulting top panel length, and four plies for the resulting bottom panel length.

Following the third fold (see FIG. 2B-4, at a designated location on the resulting top panel length, a single glue spot 25 (or glue spots) is made thereon, with a suitable adhesive. If desired, the gluing step may be omitted.

At FIG. 2B-5, a fourth fold 28 is made to complete the outsert. The fourth fold is made across the entire width of the sheet stock at a right angle from the point of origin, the fourth fold being located at the closed-end of the folded sheet stock. This fourth fold is equal to approximately ½ of the total panel length and will result in the sheet stock now having a resulting top panel length (L1) and a resulting adjoining bottom panel length (L2) (i.e., L1=½ L and L2=½ L). This fourth fold is made in a manner whereby the adhesive will maintain the outsert in a more or less fixed and compact relationship with respect to the top and bottom panel lengths of the folded sheet stock. Following completion of this final fold, the outsert will have an overall thickness of twelve plies.

Figures 2, 2B, 3, 4:
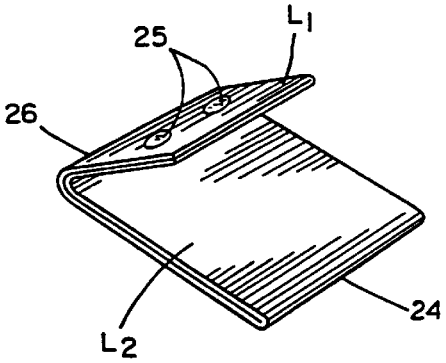
Figures 2, 2B, 3, 4, 5:
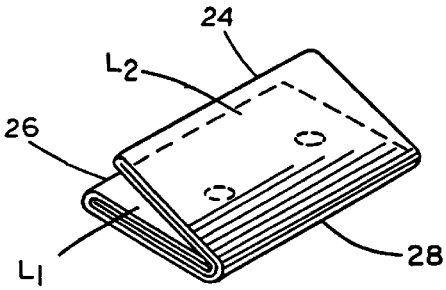
Figure 3A:
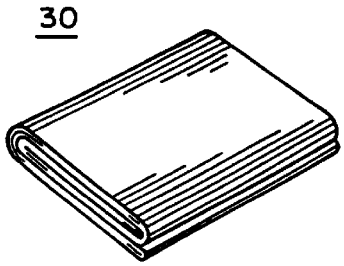
FIG. 3A is a perspective view of a second embodiment of an outsert.
Figures 1, 3B:
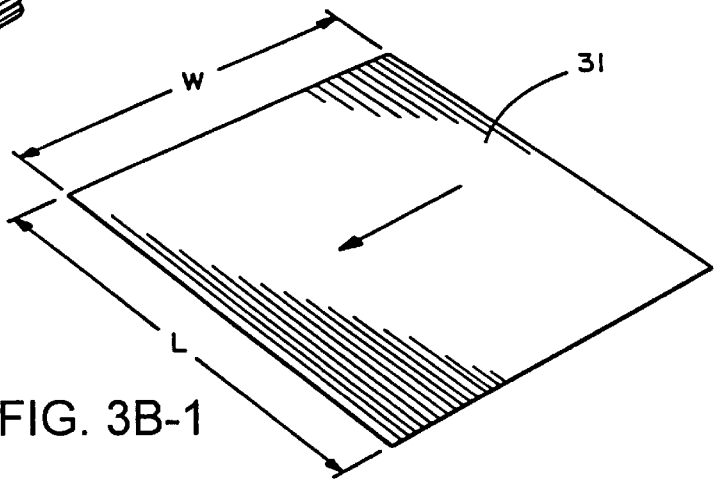
Figures 2A, 3B:
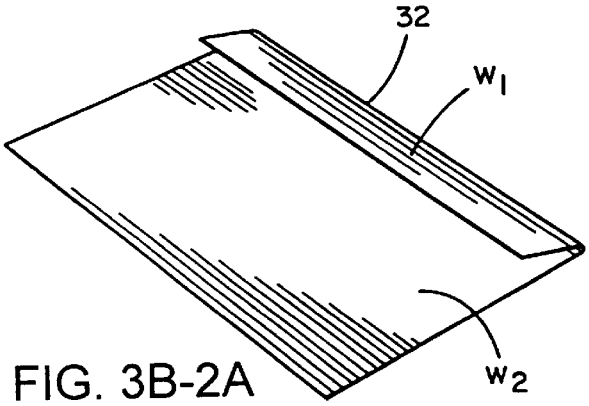
Figures 2C, 3B:
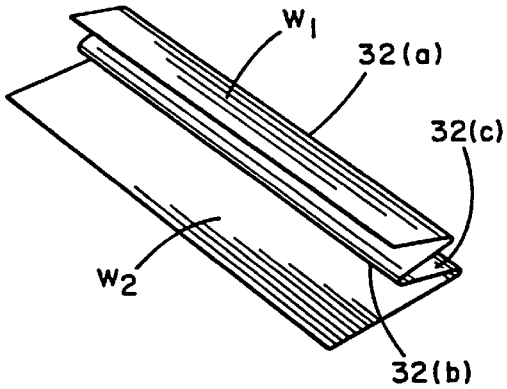
Figures 2B, 3B:
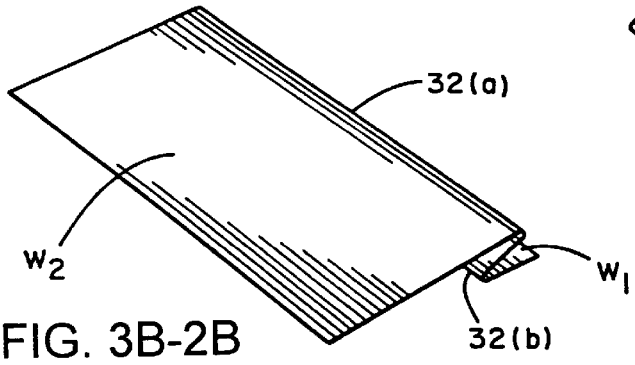
Figures 2D, 3B:
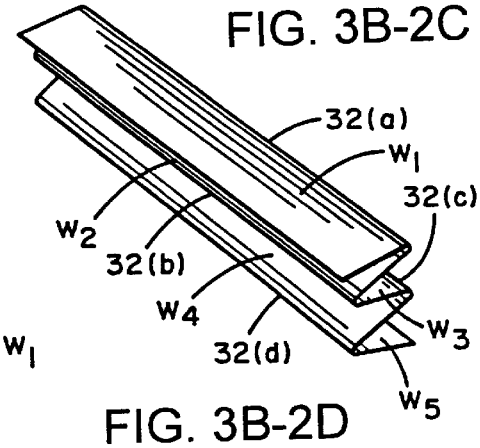
Figures 3, 3B:
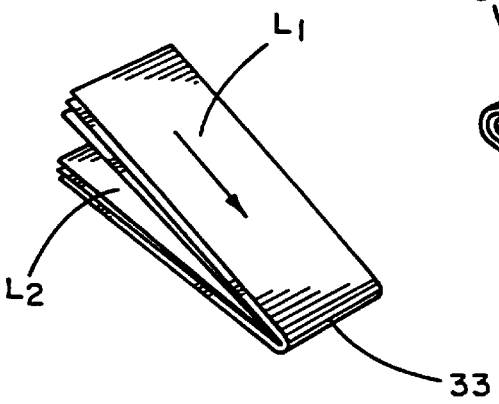
Figures 3, 3B, 4:
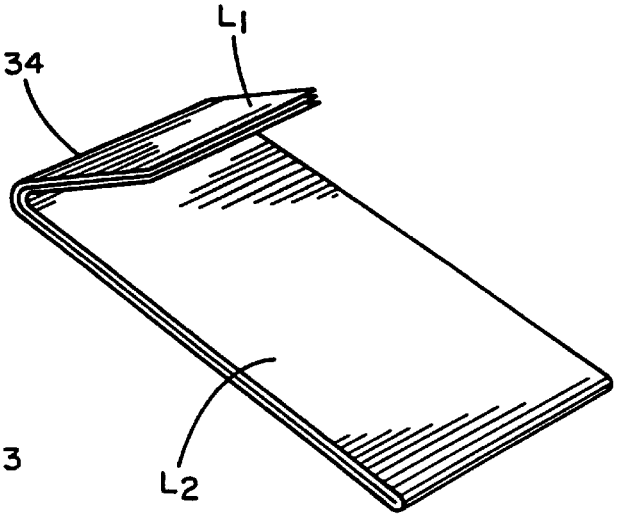
Figures 3, 3B, 4, 5:
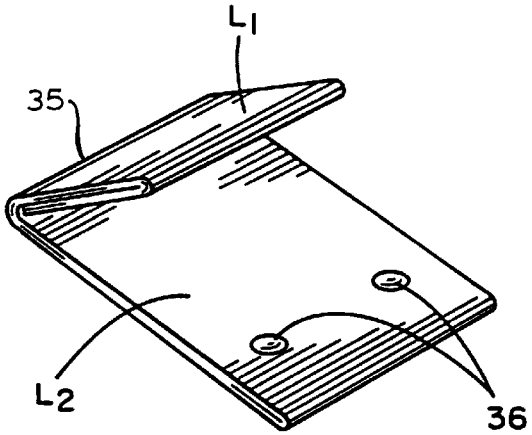

FIG. 3A is a perspective view of a universal, nonjamming, multi-ply outsert 30 having multiple folds, which is manufactured from an integral sheet of stock. FIGS. 3B-1 3B-6 illustrate the method of forming the outsert 30 depicted in FIG. 3A. Referring to FIGS. 3A and 3B, the method starts with web stock that is fed to an in-line cutter, where the stock is cut into separate individual sheets (or, alternatively, starting with individual sheet stock which is automatically stacked and fed). The size of the individual sheet stock is variable. For example, it has been demonstrated that starting with a commercial grade sheet stock having an overall length (L) of approximately 12 inches, and an overall width (W) of approximately 11 inches, an outsert can be manufactured having a total of eight folds, forty total ply thickness, and an overall size of approximately 2.25 inches wide, approximately 1.5 inches high, and approximately 0.3125 inches thick (depending on the thickness of the individual sheet stock used).

To manufacture the outsert depicted in FIG. 3A, starting at FIG. 3B-1, and with the individual sheet stock 31 traveling in a predetermined first direction, an initial fold 32, which consists of a number of substantially parallel folds (consisting of a series of tandem folds 32(*a*), 32(*b*), 32(*c*) and 32(*d*) comprising a four-fold accordion fold), is made across the entire length of the sheet stock and is at a right angle from the point of origin (see FIG. 3B-2. This initial fold 32 may be an even fold or an uneven fold (i.e., may be folded over to less than all of the adjoining section of sheet stock).

If the initial fold 32 is an even fold, the resulting width will be ⅕ of the initial width (i.e., W1=W2=W3=W4=W5= ⅕ W). This initial fold is a four-fold tandem accordion fold and, assuming the initial fold has equal panels, each panel will consist of the four-fold tandem accordion fold that is equal to ⅕ the original width (i.e., W1=⅕ W). This initial fold results in the sheet stock having a tandem series of substantially equally-sized adjoining panels, with accordion folds (running length-wise) being positioned between adjacent panels. Following completion of this initial fold, the sheet stock will have an overall thickness of five plies.

At FIG. 3B-3, and following the re-orientation of the individual sheet stock 31 to a different predetermined second direction (i.e., re-oriented substantially 90 degrees from the first direction), a second fold 33 is then made across the entire width of the sheet stock at a designated location and is at a right angle from the point of origin. This second fold may be an even fold or an uneven fold (i.e., may be folded over to less than all of the adjoining section of the sheet stock). This second fold will result in the sheet stock having a top panel length (L1) and an adjoining bottom panel length (L2).

If the second fold is an even fold, the resulting length will be ½ of the initial length (i.e., L1=L2=½ L). Following completion of this second fold, the sheet stock will have an overall thickness of ten plies. Also, after completion of this second fold, the resulting folded sheet stock will have two ends of orientation, one end being a folded closed-end, and the other end being an open-edge end, not having any fold.

At FIG. 3B-4, a third fold 34 is made across the entire width of the sheet stock at a right angle from the point of origin, the third fold being located at the open-edge end of the folded sheet stock. This third fold is equal to approximately ¼ of the total panel length and will result in the sheet stock now having a resulting top panel length (L1) and a resulting adjoining bottom panel length (L2) (i.e., L1=¼ L and L2=¾ L). Following completion of this third fold, the sheet stock will have an overall thickness of twenty plies for the resulting top panel length, and ten plies for the resulting bottom panel length.

At FIG. 3B-5, a fourth fold 35 is made across the entire width of the sheet stock at a right angle from the point of origin, the fourth fold being located at the section of folded sheet stock that is adjacent to the open-edge end portion of the folded sheet stock. This fourth fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this fourth fold, the sheet stock will have an overall thickness of thirty plies for the resulting top panel length, and ten plies for the resulting bottom panel length.

At FIG. 3B-5, following the fourth fold, at a designated location on the resulting bottom panel length, a single glue spot 36 (or glue spots) is made thereon, with a suitable adhesive. If desired, the gluing step may be omitted.

At FIG. 3B-6, a fifth fold 37 is made to complete the outsert. The fifth fold is made across the entire width of the sheet stock at a right angle from the point of origin, the fifth fold being located at the section of folded sheet stock that is next to the adjacent section previously discussed (i.e., the adjacent section being next to the open-edge end portion of the folded sheet stock). This fifth fold is equal to approximately ½ of the total panel length and will result in the sheet stock now having a resulting top panel length (L1) and a resulting adjoining bottom panel length (L2) (i.e., L1=½ L and L2=½ L). This fifth fold is made in a manner whereby the adhesive will maintain the outsert in a more or less fixed and compact relationship with respect to the top and bottom panel lengths of the folded sheet stock. Following completion of this final fold, the outsert will have an overall thickness of forty plies.

FIG. 4A is a perspective view of a universal, nonjamming, multi-ply outsert 50 having multiple folds, which is manufactured from an integral sheet of stock. FIGS. 4B-1 4B-7 illustrate the method of forming the outsert 50 depicted in FIG. 4A. Referring to FIGS. 4A and 4B, the method starts with web stock that is fed to an in-line cutter, where the stock is cut into separate individual sheets (or, alternatively, starting with individual sheet stock which is automatically stacked and fed). The size of the individual sheet stock is variable. For example, it has been demonstrated that starting with a commercial grade sheet stock having an overall length (L) of approximately 18 inches, and an overall width (W) of approximately 12 inches, an outsert can be manufactured having a total of eight folds, a sixty-four total ply thickness, and an overall size of approximately 2.25 inches wide, approximately 1.5 inches high, and approximately 0.25 inches thick (depending on the thickness of the individual sheet stock used).

To manufacture the outsert depicted in FIG. 4A, starting at FIG. 4B-1, and with the individual sheet stock 51 traveling in a predetermined first direction, an initial fold 52 is made across the entire length of the sheet stock and is at a right angle from the point of origin (see FIG. 4B-2. This initial fold may be an even fold or an uneven fold (i.e., may be folded over to less than all of the adjoining section of sheet stock). This initial fold results in the sheet stock having a top section (W1) and an adjoining bottom section (W2).

If the initial fold is an even fold, the resulting width will be ½ of the initial width (i.e., W1=W2=½ W). Following completion of this initial fold, the sheet stock will have an overall thickness of two plies.

At FIG. 4B-3, a second fold 53, which consists of a number of substantially parallel folds (consisting of a series of tandem folds comprising a three-fold accordion fold 54(*a*), 54(*b*) and 54(*c*)), is made across the entire length of the sheet stock and is at a right angle from the point of origin. This second fold may be an even fold or an uneven fold (i.e., may be folded over to less than all of the adjoining section of sheet stock).

If the second fold is an even fold, the resulting width will be ¼ of the initial width (i.e., W1=W2=W3=W4=¼ W). This second fold is a three-fold tandem accordion fold, and assuming the second fold has four equal panels, each panel will consist of the three-fold tandem accordion fold that is equal to ¼ the original width (i.e., W1=¼ W). This second fold results in the sheet stock having a tandem series of substantially equally-sized adjoining panels, with accordion folds (running length-wise) being positioned between adjacent panels. Following completion of this fold, the sheet stock will have an overall thickness of eight plies.

At FIG. 4B-4, and following the re-orientation of the individual sheet stock 51 to a different predetermined second direction (i.e., re-oriented substantially 90 degrees from the first direction), a third fold 55 is then made across the entire width of the sheet stock at a designated location and is at a right angle from the point of origin. This third fold is an uneven fold (i.e., a short fold); this third fold will result in the sheet stock having a top panel length (L1) having open edges and an adjoining bottom panel length (L2) having no open edges (but having one end with open edges). The third fold will create a top panel having open edges that is equal to ⅜ of the initial length (L1=⅜ L) and an adjoining bottom panel (L2=⅝ L). Following completion of this third fold, the outsert will have an overall thickness of sixteen plies. Also, after completion of this third fold, the resulting folded sheet stock will have two ends of orientation, one end longer than the other end.

Figure 1A:
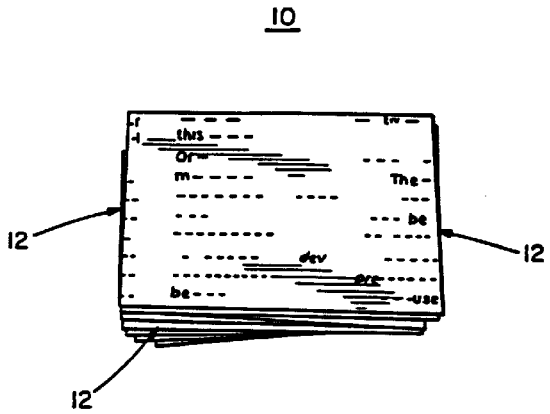
PRIOR ART FIG. 1A
FIG. 1A illustrates an example of an outsert having open edges about its periphery constructed in accordance with the prior art.
Figure 1B:
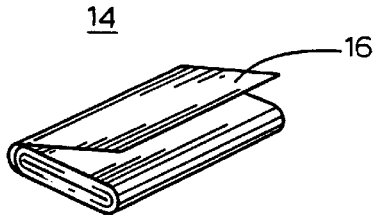
PRIOR ART FIG. 1B
FIG. 1B illustrates a ribbon style outsert constructed in accordance with the prior art.
Figure 5:
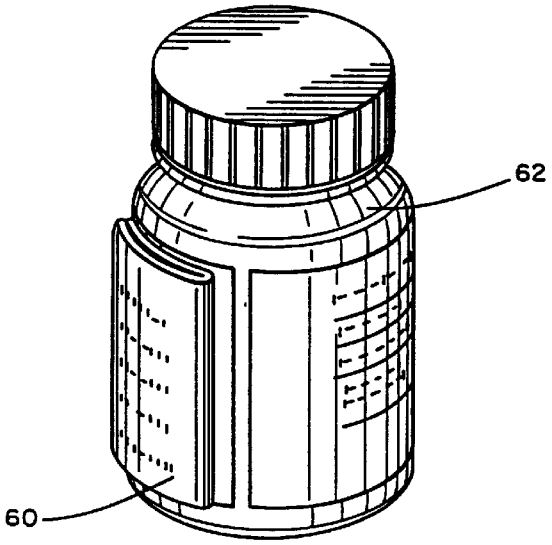
FIGS. 2B-1 through 2B-5 illustrate the method of forming the outsert illustrated in FIG. 2A.

At FIG. 4B-5, a fourth fold 56 is made across the entire width of the sheet stock at a designated location and is at a right angle from the point of origin at a location on the short panel lengths. This fourth fold is an uneven fold (i.e., a short fold) and is located at the shorter top panel end having open-edges of the folded sheet stock. This fourth fold will result in the sheet stock having a top panel length (L1) having no open peripheral edges and an adjoining bottom panel length (L2) having no open peripheral edges. The fourth fold will create a top panel that is equal to ⅖ of the initial length (L1=⅖ L) and an adjoining bottom panel that is equal to ⅗ of the initial length (L2=⅗ L). Following completion of this fourth fold, the outsert will have an overall thickness of twenty-four plies (and sixteen plies at the other portion of the outsert). Also, after completion of this fourth fold, the resulting folded sheet stock will have two ends of orientation, each end having no open edges.

At FIG. 4B-6, a fifth fold 57 is made across the entire width of the sheet stock at a right angle from the point of origin, the fifth fold being located at the section of folded sheet stock that is adjacent to the open-edge end portion of the folded sheet stock on the panel having the longer panel length. This fifth fold is equal to approximately ⅓ of the total panel length and will result in the outsert now having a resulting top panel length (L1) and a resulting adjoining bottom panel length (L2) (i.e., L1=⅓ L and L2=⅔ L). Each of the resulting adjoining bottom and top panels will now have closed ends (i.e., no open edges). Following completion of this fifth fold, the sheet stock will have an overall thickness of forty plies for the resulting bottom panel length, and twenty-four plies for the resulting top panel length.

At FIG. 4B-6, following the fifth fold, at a designated location on the resulting top panel length, a single glue spot 58 (or glue spots) is made thereon, with a suitable adhesive. If desired, the gluing step may be omitted.

At FIG. 4B-7, a sixth fold 59 is made to complete the outsert. The sixth fold is made across the entire width of the sheet stock at a right angle from the point of origin. This sixth fold is equal to approximately ½ of the total panel length and will result in the sheet stock now having a resulting top panel length (L1) and a resulting adjoining bottom panel length (L2) (i.e., L1=½ L and L2=½ L). This sixth fold is made and folded over the second end of the resulting panel length and is made in a manner whereby the adhesive will maintain the outsert in a more or less fixed and compact relationship with respect to the top and bottom panel lengths of the folded sheet stock. Following completion of this final fold, the outsert will have an overall thickness of sixty-four plies.

FIG. 5 is a perspective view of an outsert 60 applied to the outside of a container 62 for a pharmaceutical product.

Figure 6A:
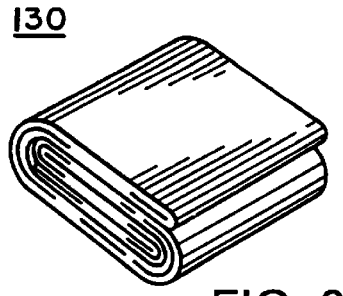
FIG. 6A is a perspective view of a fourth embodiment of an outsert.
Figures 1, 6B:
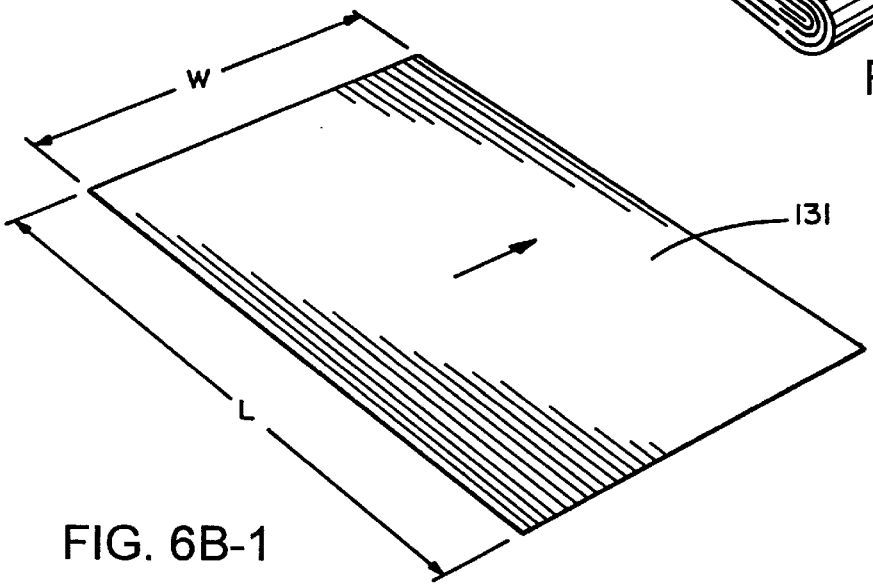
Figures 3, 6B:
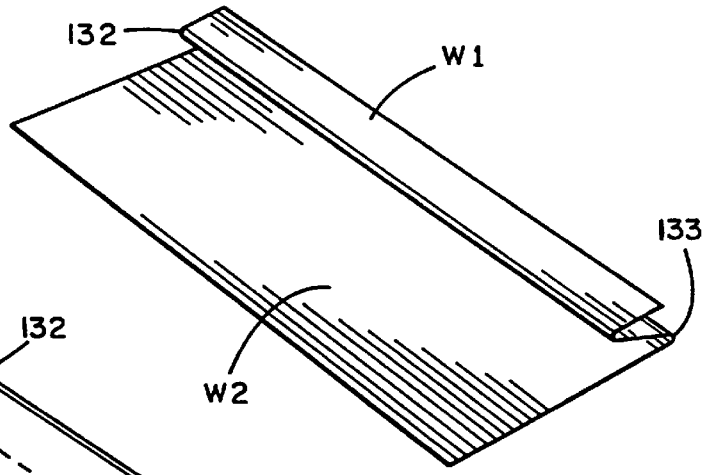
Figures 2, 6B:
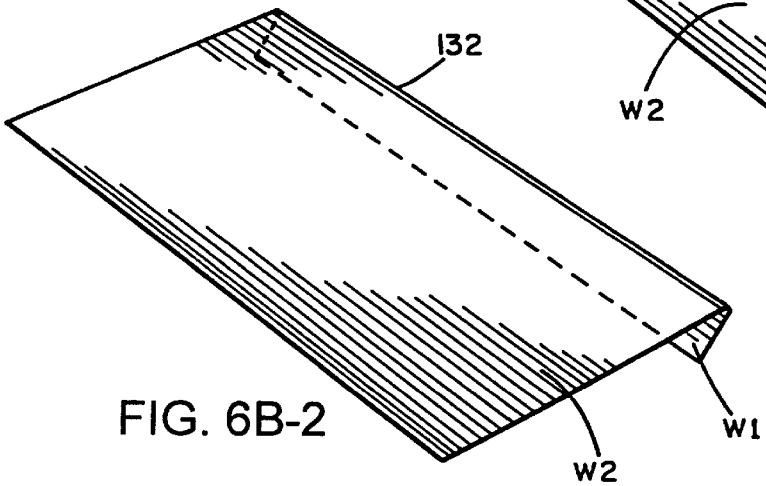
Figures 4, 6B:
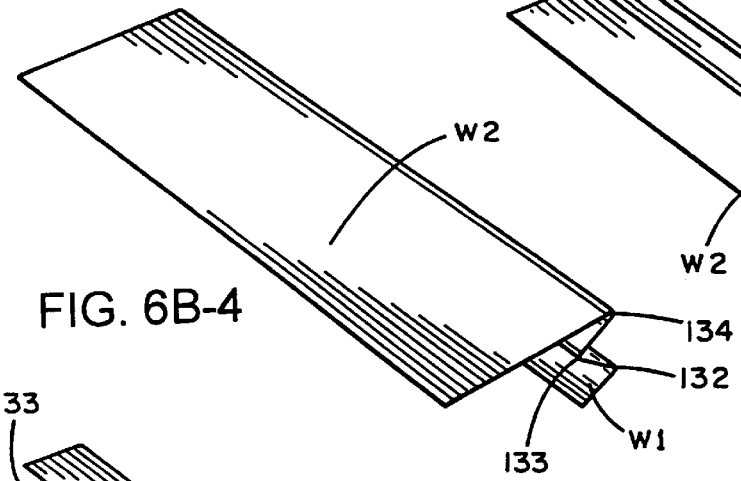
Figures 5, 6B:
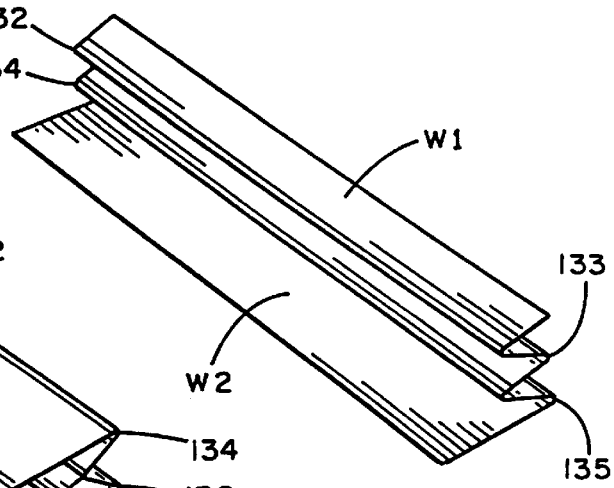
Figures 6, 6B:
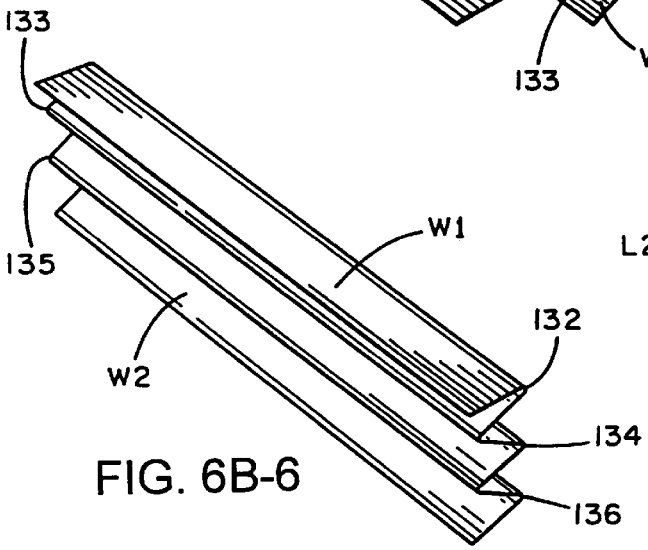

FIG. 6A is a perspective view of a universal, nonjamming, multi-ply, multi-fold, reduced-size outsert 130 having increased copyspace, which is manufactured from an integral sheet of stock. FIGS. 6B-1–6B-10 illustrate the method of forming the outsert 130 depicted in FIG. 6A. Referring to FIGS. 6A and 6B, the method starts with web stock that is directly fed to an in-line cutter, where the stock is cut into separate individual sheets (or, alternatively, starting with individual sheet stock which is automatically stacked and fed). The size and weight of the individual sheet stock are variable. For example, it has been demonstrated that starting with a commercial grade sheet stock having an overall length (L) of approximately 11 inches, and an overall width (W) of approximately 6.625 inches, an outsert can be manufactured having nine folds, a total thickness of sixty plies, and an overall size of approximately 1.125 inches long, approximately 1.125 inches wide, and approximately 0.188 inches thick (depending on the thickness of the sheet stock utilized).

To manufacture the outsert depicted in FIG. 6A, starting at FIG. 6B-1, and with the individual sheet stock 131 traveling in a predetermined first direction, an initial accordion fold is made across the entire length of the sheet stock and is at a right angle from the point of origin (see FIG. 6B-2. This initial fold consists of a number of substantially parallel folds (consisting of a series of tandem folds 132, 133, 134, 135 and 136, comprising a five-fold accordion fold), and is made across the entire length of the sheet stock and is at a right angle from the point of origin (see FIGS. 6B-2–6B-6).

This initial fold is a five-fold tandem accordion fold and results in the sheet stock having a tandem series of substantially equally-sized adjoining panels, with accordion folds (running length-wise) being positioned between adjacent panels. The initial fold may be an even fold or an uneven fold (i.e., may be folded over to less than all of the adjoining section of sheet stock). Assuming the initial fold has equal panels (e.g., the initial fold is an even fold), each panel will consist of the five-fold tandem accordion fold that is equal to ⅙ the original width (i.e., W1=⅙ W) and the resulting width of each panel will be ⅙ of the initial width (i.e., W1=W2=W3=W4=W5=W6=⅙ W). Following completion of this initial fold, the sheet stock will have an overall thickness of six plies.

Figures 3, 3B, 4, 5, 6:
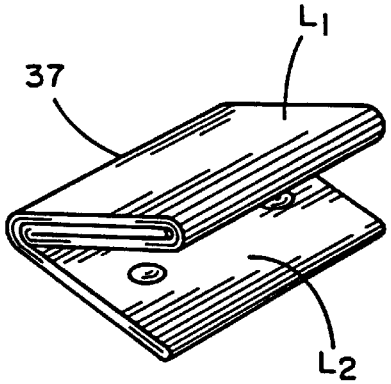
Figures 6, 6B, 7, 8:
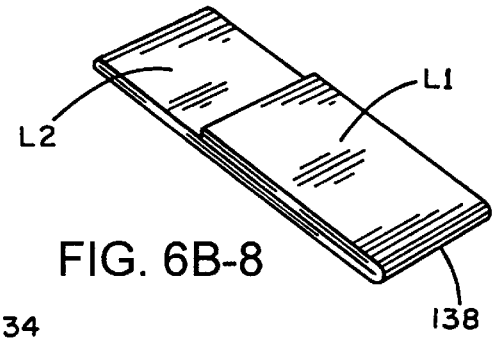
Figures 6, 6B, 7, 8, 9:
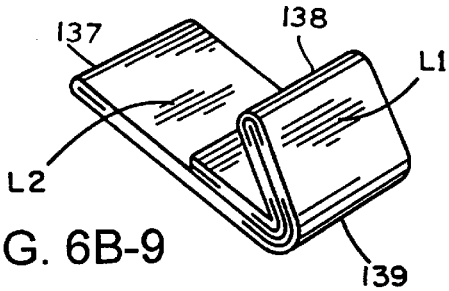
Figures 6, 6B, 7:
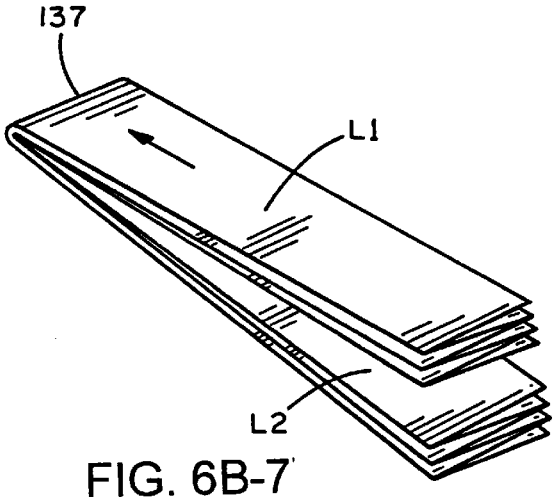
Figures 6, 6B, 7, 8, 9, 10:
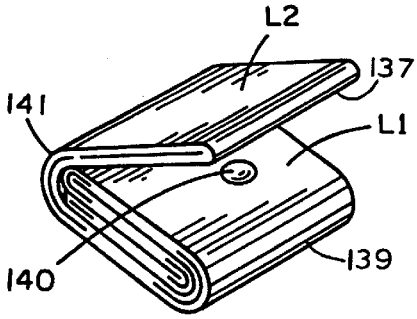

At FIG. 6B-7, and following the re-orientation of the individual sheet stock 131 to a different predetermined second direction (i.e., re-oriented substantially 90 degrees from the first direction), a sixth fold 137 is then made across the entire width of the sheet stock at a designated location and is at a right angle from the point of origin. This sixth fold may be an even fold or an uneven fold (i.e., may be folded over to less than all of the adjoining section of the sheet stock). This sixth fold will result in the sheet stock having a top panel length (L1) and an adjoining bottom panel length (L2).

If the sixth fold is an even fold, the resulting panel length will be ½ of the initial length (i.e., L1=L2=½ L). Following completion of this sixth fold, the sheet stock will have an overall maximum thickness of twelve plies. Also, after completion of this sixth fold, the resulting folded sheet stock will have two ends of orientation, one end being a folded closed-end, and the other end being an open-edge end, not having any fold.

At FIG. 6B-8, a seventh fold 138 is made across the entire width of the sheet stock at a right angle from the point of origin, the seventh fold being located at the open-edge end of the folded sheet stock. This seventh fold is equal to approximately ⅖ of the total panel length and will result in the sheet stock now having a resulting top panel length (L1) and a resulting adjoining bottom panel length (L2) (i.e., L1=⅖ L and L2=⅗ L). Following completion of this seventh fold, the sheet stock will have an overall maximum thickness of twenty-four plies (e.g., resulting in twelve ply thickness at one end of the outsert and resulting in twenty-four ply thickness at the opposite end of the outsert).

At FIG. 6B-9, an eighth fold 139 is made across the entire width of the sheet stock at a right angle from the point of origin. This eighth fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this eighth fold, the sheet stock will have an overall maximum thickness of forty-eight plies (e.g., resulting in twelve ply thickness at one end of the outsert and resulting in forty-eight ply thickness at the opposite end of the outsert).

At FIG. 6B-10, following the eighth fold, at a designated location on the outsert, a single glue spot 140 (or glue spots) is made thereon, with a suitable adhesive. If desired, the gluing step may be omitted.

At FIG. 6B-10, a ninth fold 141 is made to complete the outsert. The ninth fold is made across the entire width of the sheet stock at a right angle from the point of origin. This ninth fold is equal to approximately ½ of the total panel length and will result in the sheet stock now having a resulting top panel length (L1) and a resulting adjoining bottom panel length (L2) (i.e., L1=½ L and L2 ½ L)=This ninth fold is made in a manner whereby the adhesive will maintain the outsert in a more or less fixed and compact relationship with respect to the top and bottom panel lengths of the folded sheet stock. Following completion of this final fold, the outsert will have an overall thickness of sixty plies.

The method of forming the outsert 130 depicted in FIG. 6A may be modified slightly to form an outsert having a slightly different structure. In particular, the method of forming the outsert 130 may be modified in the following respects: 1) the modified method utilizes a sheet of stock having an overall length (L) of approximately 18 inches and an overall width (W) of approximately 10 inches; 2) in the modified method, an accordion fold having eight tandem folds (to produce nine equal-length panels) is initially made (instead of an accordion fold with five tandem folds as shown in FIG. 6B-6; 3) in the modified method, the accordion fold is made in the direction parallel to the width of the sheet stock (instead of parallel to the length of the sheet stock as shown in FIGS. 6B-1–6B-6; and 4) two spots of glue may be used (instead of the single spot 140 shown in FIG. 6B-10). This or modified method will form an outsert having twelve folds, a total thickness of ninety plies, and an overall size of approximately 2 inches long, approximately 1 inch wide, and approximately 0.25 inches thick (depending on the thickness of the sheet stock used).

Figure 7A:
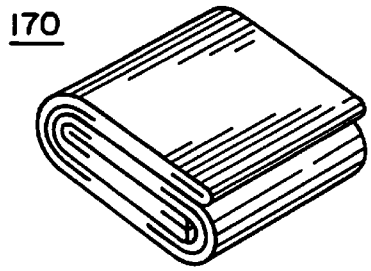
FIG. 7A is a perspective view of a fifth embodiment of an outsert.
Figures 1, 7B:
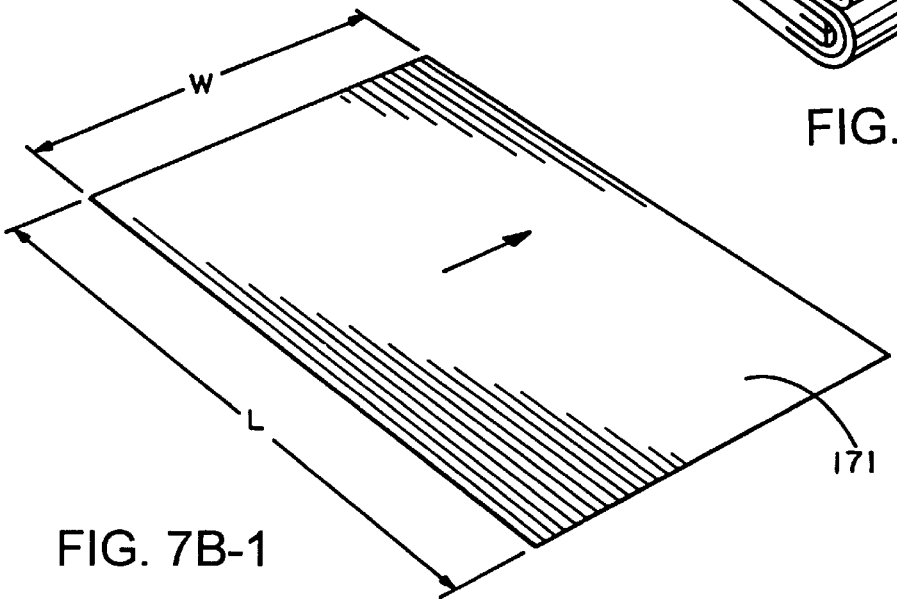
Figures 2, 7B:
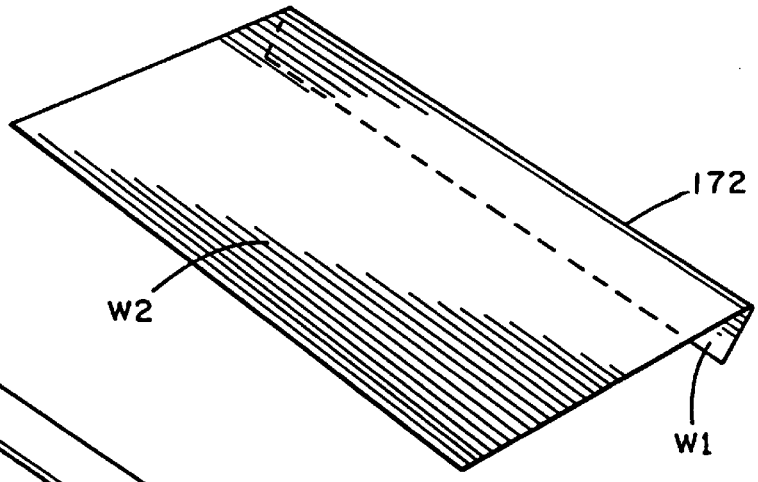
Figures 3, 7B:
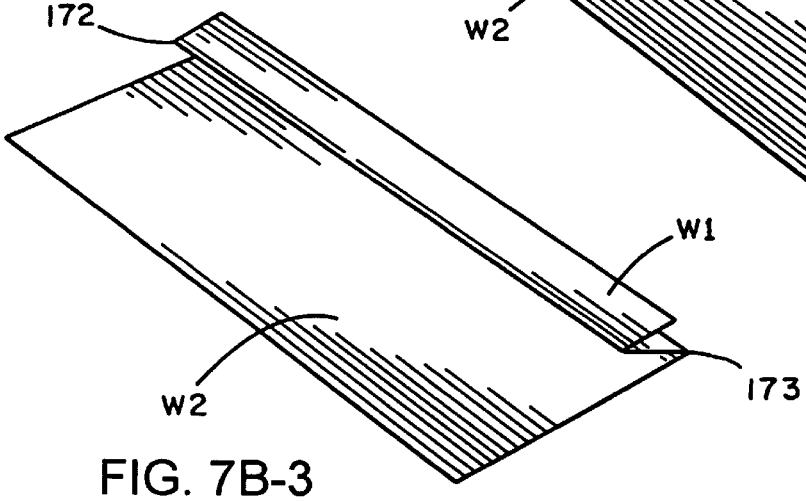
Figures 4, 7B:
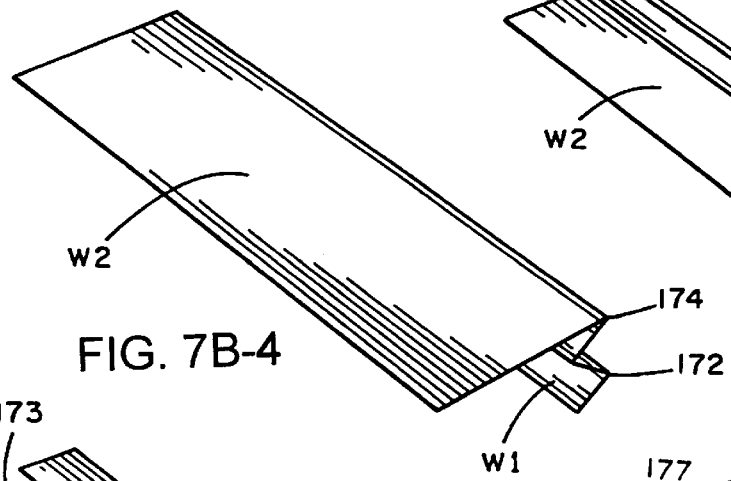
Figures 5, 7B:
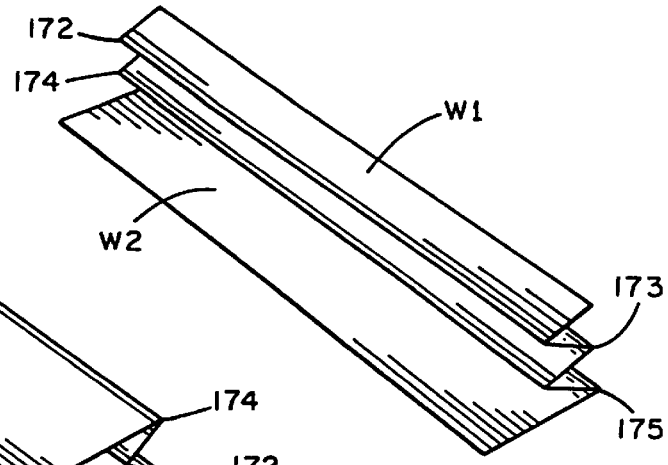
Figures 6, 7B:
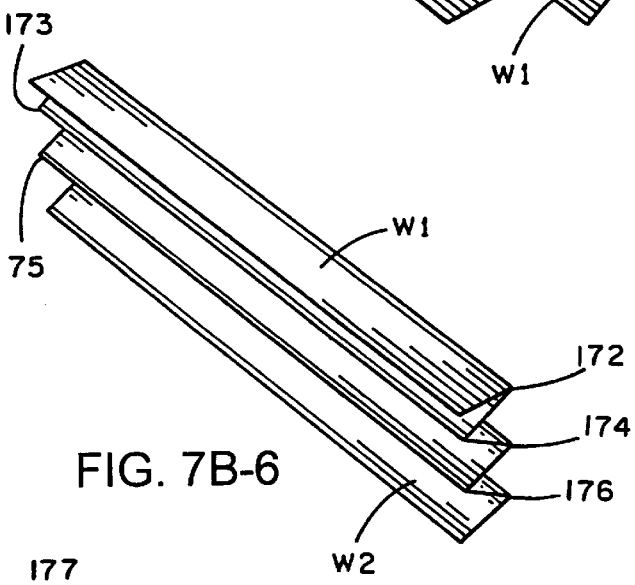
Figures 7, 7B, 8:
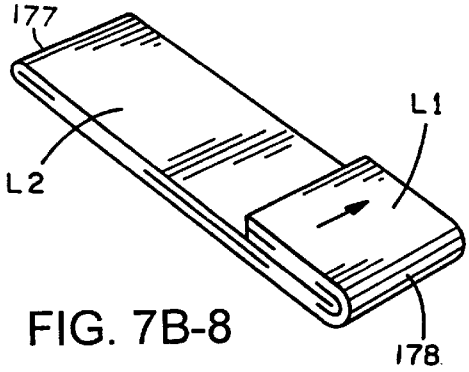
Figures 7, 7B:
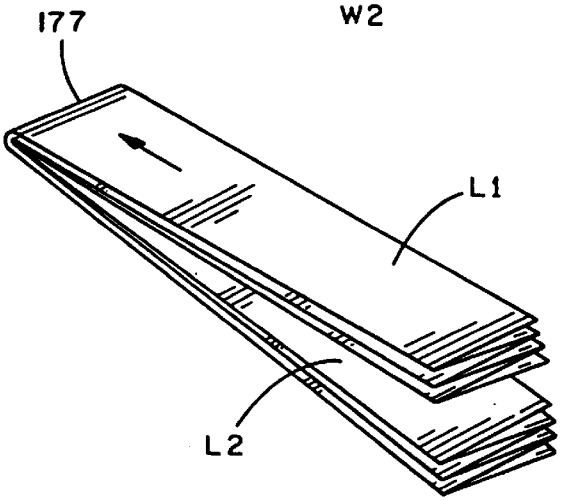
Figures 7, 7B, 8, 9:
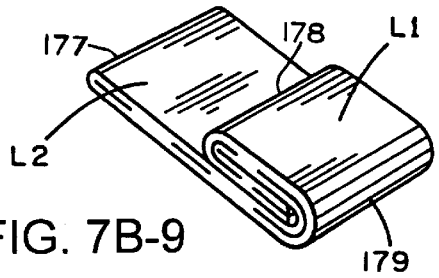
Figures 7, 7B, 8, 9, 10:
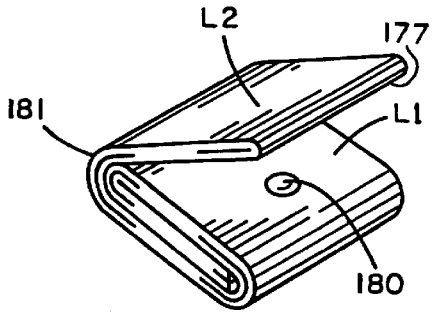

FIG. 7A is a perspective view of a universal, nonjamming, multi-ply, multi-fold, reduced-size outsert 170 having increased copyspace, which is manufactured from an integral sheet of stock. FIGS. 7B-1–7B-10 illustrate the method of forming the outsert 170 depicted in FIG. 7A. Referring to FIGS. 7A and 7B, the method starts with web stock that is fed to an in-line cutter, where the stock is cut into separate individual sheets (or, alternatively, starting with individual sheet stock which is automatically stacked and fed). The size and weight of the individual sheet stock are variable. For example, it has been demonstrated that starting with a commercial grade sheet stock having an overall length (L) of approximately 10 inches, and an overall width (W) of approximately 7.5 inches, an outsert can be manufactured having a total of nine folds, a total thickness of forty-eight plies, and an overall size of approximately 1.375 inches long, approximately 1.375 inches wide, and approximately 0.188 inches thick (depending on the thickness of the individual sheet stock utilized).

To manufacture the outsert depicted in FIG. 7A, starting at FIG. 7B-1, and with the individual sheet stock 171 traveling in a predetermined first direction, an initial accordion fold is made across the entire length of the sheet stock and is at a right angle from the point of origin (see FIG. 7B-2. This initial fold consists of a number of substantially parallel folds (consisting of a series of tandem folds 172, 173, 174, 175 and 176, comprising a five-fold accordion fold), and is made across the entire length of the sheet stock and is at a right angle from the point of origin (see FIGS. 7B-2–7B-6.

This initial fold is a five-fold tandem accordion fold and results in the sheet stock having a tandem series of substantially equally-sized adjoining panels, with accordion folds (running length-wise) being positioned between adjacent panels. The initial fold may be an even fold or an uneven fold (i.e., may be folded over to less than all of the adjoining section of sheet stock). Assuming the initial fold has equal panels (e.g., the initial fold is an even fold), each panel will consist of the five-fold tandem accordion fold that is equal to ⅙ the original width (i.e., W1=⅙ W) and the resulting width of each panel will be ⅙ of the initial width (i.e., W1=W2=W3=W4=W5=W6=⅙ W). Following completion of this initial fold, the sheet stock will have an overall thickness of six plies.

At FIG. 7B-7, and following the re-orientation of the individual sheet stock 171 to a different predetermined second direction (i.e., re-oriented substantially 90 degrees from the first direction), a sixth fold 177 is then made across the entire width of the sheet stock at a designated location and is at a right angle from the point of origin. This sixth fold may be an even fold or an uneven fold (i.e., may be folded over to less than all of the adjoining section of the sheet stock). This sixth fold will result in the sheet stock having a top panel length (L1) and an adjoining bottom panel length (L2).

If the sixth fold is an even fold, the resulting panel length will be ½ of the initial length (i.e., L1=L2=½ L). Following completion of this sixth fold, the sheet stock will have an overall maximum thickness of twelve plies. Also, after completion of this sixth fold, the resulting folded sheet stock will have two ends of orientation, one end being is a folded closed end, and the other end being an open-edge end, not having any fold.

Figure 8:
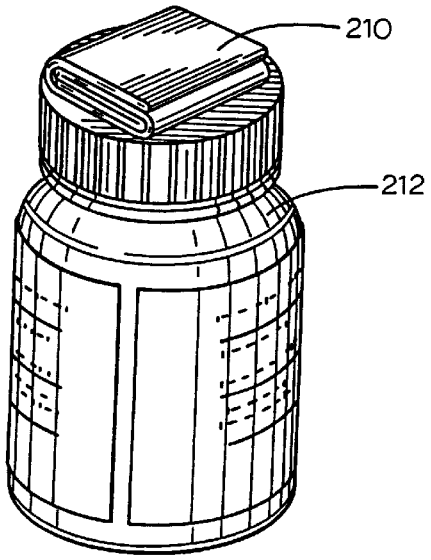

At FIG. 7B-8, a seventh fold 178 is made across the entire width of the sheet stock at a right angle from the point of origin, the seventh fold being located at the open-edge end of the folded sheet stock. This seventh fold is equal to approximately ⅕ of the total panel length and will result in the sheet stock now having a resulting top panel length (L1) and a resulting adjoining bottom panel length (L2) (i.e., L1=⅕ L and L2=⅘ L). Following completion of this seventh fold, the sheet stock will have an overall maximum thickness of twenty-four plies (e.g., resulting in twelve ply thickness at one end of the outsert and resulting in twenty-four ply thickness at the opposite end of the outsert).

At FIG. 7B-9, an eighth fold 179 is made across the entire width of the sheet stock at a right angle from the point of origin. This eighth fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this eighth fold, the sheet stock will have an overall maximum thickness of thirty-six plies (e.g., resulting in twelve ply thickness at one end of the outsert and resulting in thirty-six ply thickness at the opposite end of the outsert).

At FIG. 7B-10, following the eighth fold, at a designated location on the outsert, a single glue spot 180 (or glue spots) is made thereon, with a suitable adhesive. If desired, the gluing step may be omitted.

At FIG. 7B-10, a ninth fold 181 is made to complete the outsert. The ninth fold is made across the entire width of the sheet stock at a right angle from the point of origin. This ninth fold is equal to approximately ½ of the total panel length and will result in the sheet stock now having a resulting top panel length (L1) and a resulting adjoining bottom panel length (L2) (i.e., L1=½ L and L2=½ L). This ninth fold is made in a manner whereby the adhesive will maintain the outsert in a more or less fixed and compact relationship with respect to the top and bottom panels lengths of the folded sheet stock. Following completion of this final fold, the outsert will have an overall thickness of forty eight-plies.

The method of forming the outsert 170 depicted in FIG. 7A may be modified slightly to form an outsert having a slightly different structure. In particular, the method of forming the outsert 170 may be modified in the following respects: 1) the modified method utilizes a sheet of stock having an overall length (L) of approximately 24 inches and an overall width (W) of approximately 10 inches; 2) in the modified method, an accordion fold having seven tandem folds (to produce eight equal-length panels) is initially made (instead of an accordion fold with five tandem folds as shown in FIG. 7B-6; 3) in the modified method, the accordion fold is made in the direction parallel to the width of the sheet stock (instead of parallel to the length of the sheet stock as shown in FIGS. 7B-1–7B-6; and 4) two spots of glue may be used (instead of the single spot 180 shown in FIG. 7B-10). This modified method will form an outsert having eleven folds, a total thickness of sixty-four plies, and an overall size of approximately 1.25 inches long, approximately 3 inches wide, and approximately 0.188 inches thick (depending on the thickness of the sheet stock used).

FIG. 8 is a perspective view of an outsert 210 applied to the top of a container 212 for a pharmaceutical product.

Each of the outserts described above may optionally be imperceptibly scored at various positions intrinsic to the outsert (indicating that the outsert is folded in a particular direction along the score line), to assist in the folding of the outsert, and, accordingly, each score line is part and parcel of each outsert.

The methods of folding described above in connection with FIGS. 2B–4B and 6B–7B eliminate all unfolded exterior edges which lie in a direction parallel to the final fold direction, resulting in outserts having a more compact three-dimensional physical envelope. Inasmuch as the outserts depicted in FIGS. 2A–4A and 6A–7A are manufactured from a single sheet of stock, the outserts do not require any trimming step to be performed to achieve a certain size. The final size of the outserts is achieved by selecting a particular respective size of initial sheet stock to be utilized.

Although specific dimensions have been disclosed herein for the sheet stock from which outserts are formed and for the final outserts themselves, those particular dimensions are not considered important to the invention, and outserts having different dimensions may be formed from sheet stock having different dimensions.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of producing a folded item having printed information thereon to provide information about a product, said folded item having a plurality of sheet portions, said method comprising the steps of:

(a) forming a first folded article having a first end, a second end, a length along a first direction, and a width along a second direction perpendicular to said first direction, said first folded article having a plurality of first elongate sheet portions and a plurality of second elongate sheet portions, each of said first elongate sheet portions having a first end and a second end, and each of said second elongate sheet portions having a first end and a second end, each of said first ends of said first elongate sheet portions being joined to a respective one of said first ends of said second elongate sheet portions at a respective fold coinciding with said first end of said first folded article so that said first end of said first folded article has no exterior unfolded sheet edges, each of said respective folds being parallel to said second direction;

(b) folding said first folded article by making a transverse fold in said first folded article to form a second folded article, said second folded article having a first end and a second end, said transverse fold in said first folded article being parallel to said second direction and being made so that said second end of said first folded article is disposed between said first end of said second folded article and said second end of said second folded article, said transverse fold being made at a point along said length of said first folded article, said point being spaced from said second end of said first folded article by a distance equal to approximately one-third of said length of said first folded article;

(c) depositing an adhesive on a portion of said second folded article; and (d) making a transverse fold in said second folded article in a direction parallel to said second direction to form said folded item, said transverse fold in said second folded article being made so that said second end of said first folded article is covered by one of said sheet portions of said folded item and so that said folded item has no exterior unfolded sheet edges that lie in a direction parallel to said second direction, said transverse fold in said second folded article being made at a point approximately equidistant between said first end of said second folded article and said second end of said second folded article.

2. An item formed in accordance with the method defined in claim 1.

3. A method of producing a folded item having printed information thereon to provide information about a product, said folded item having a plurality of sheet portions, said method comprising the steps of:

(a) forming a first folded article having a first end and a second end, said first folded article having a first elongate sheet portion having a length along a first direction and a width along a second direction perpendicular to said first direction, said length of said first elongate sheet portion being greater than said width of said first elongate sheet portion, said first folded article having a second elongate sheet portion having a length along said first direction and a width along said second direction, said length of said second elongate sheet portion being greater than said width of said second elongate sheet portion, said first elongate sheet portion having a first end and a second end and said second elongate sheet portion having a first end and a second end, said first end of said first elongate sheet portion being joined to said first end of said second elongate sheet portion at a fold coinciding with said first end of said first folded article so that said first end of said first folded article has no exterior unfolded sheet edges, said fold being parallel to said second direction;

(b) folding said first folded article by making a transverse fold in said first folded article to form a second folded article, said second folded article having a first end and a second end, said transverse fold in said first folded article being parallel to said second direction and being made so that said second end of said first folded article is disposed between said first end of said second folded article and said second end of said second folded article, said transverse fold being made at a point along said length of said first folded article, said point being spaced from said second end of said first folded article by a distance equal to approximately one-third of said length of said first folded article; and (c) making a transverse fold in said second folded article in a direction parallel to said second direction to form said folded item, said transverse fold in said second folded article being made so that said second end of said first folded article is covered by one of said sheet portions of said folded item and so that said folded item has no exterior unfolded sheet edges that lie in a direction parallel to said second direction, said transverse fold in said second folded article being made at a point approximately equidistant between said first end of said second folded article and said second end of said second folded article.

4. An item formed in accordance with the method defined in claim 3.

5. A method of producing a folded item having printed information thereon to provide information about a product, said folded item having a plurality of sheet portions, said method comprising the steps of:

(a) forming a first folded article having a first end, a second end, a length along a first direction, and a width along a second direction perpendicular to said first direction, said first folded article having a plurality of first elongate sheet portions and a plurality of second elongate sheet portions, each of said first elongate sheet portions having a first end and a second end, and each of said second elongate sheet portions having a first end and a second end, each of said first ends of said first elongate sheet portions being joined to a respective one of said first ends of said second elongate sheet portions at a respective fold coinciding with said first end of said first folded article so that said first end of said first folded article has no exterior unfolded sheet edges, each of said respective folds being parallel to said second direction;

(b) folding said first folded article by making a transverse fold in said first folded article to form a second folded article, said second folded article having a first end and a second end, said transverse fold in said first folded article being parallel to said second direction and being made so that said second end of said first folded article is disposed between said first end of said second folded article and said second end of said second folded article, said transverse fold being made at a point along said length of said first folded article, said point being spaced from said second end of said first folded article by a distance equal to approximately one-third of said length of said first folded article; and (c) making a transverse fold in said second folded article in a direction parallel to said second direction to form said folded item, said transverse fold in said second folded article being made so that said second end of said first folded article is covered by one of said sheet portions of said folded item and so that said folded item has no exterior unfolded sheet edges that lie in a direction parallel to said second direction, said transverse fold in said second folded article being made at a point approximately equidistant between said first end of said second folded article and said second end of said second folded article.

6. An item formed in accordance with the method defined in claim 5.

7. A method of producing a folded item having printed information thereon to provide information about a product, said folded item having a plurality of sheet portions, said method comprising the steps of:

(a) forming a first folded article having a first end, a second end, a length along a first direction, and a width along a second direction perpendicular to said first direction, said first folded article having a plurality of first elongate sheet portions and a plurality of second elongate sheet portions, each of said first elongate sheet portions having a first end and a second end, and each of said second elongate sheet portions having a first end and a second end, each of said first ends of said first elongate sheet portions being joined to a respective one of said first ends of said second elongate sheet portions at a respective fold coinciding with said first end of said first folded article so that said first end of said first folded article has no exterior unfolded sheet edges, each of said respective folds being parallel to said second direction;

(b) folding said first folded article by making a transverse fold in said first folded article to form a second folded article, said second folded article having a first end and a second end, said transverse fold in said first folded article being parallel to said second direction and being made so that said second end of said first folded article is disposed between said first end of said second folded article and said second end of said second folded article, said transverse fold being made at a point along said length of said first folded article, said point being spaced from said second end of said first folded article by a distance equal to approximately one-third of said length of said first folded article;

(c) making a transverse fold in said second folded article in a direction parallel to said second direction to form said folded item, said transverse fold in said second folded article being made so that said second end of said first folded article is covered by one of said sheet portions of said folded item and so that said folded item has no exterior unfolded sheet edges that lie in a direction parallel to said second direction, said transverse fold in said second folded article being made at a point approximately equidistant between said first end of said second folded article and said second end of said second folded article; and (d) securing said folded item in a closed position.

8. A method as defined in claim 7 wherein said step (d) comprises the step of securing said folded item in a closed position with an adhesive.

9. An item formed in accordance with the method defined in claim 7.

10. An item formed in accordance with the method defined in claim 8.

* * * * *